United States Patent [19]

Dietrich et al.

[11] 4,100,843

[45] Jul. 18, 1978

[54] METHOD AND APPARATUS FOR ERECTING FOLDED BLANKS

[75] Inventors: Walter Dietrich, Auenwald; Manfred Bauer, Weinstadt, both of Fed. Rep. of Germany

[73] Assignee: Robert Bosch GmbH, Stuttgart, Fed. Rep. of Germany

[21] Appl. No.: 767,861

[22] Filed: Feb. 11, 1977

[30] Foreign Application Priority Data

Feb. 14, 1976 [DE] Fed. Rep. of Germany ..... 2606017

[51] Int. Cl.[2] ..... B31B 1/80

[52] U.S. Cl. ..... 93/53 M; 93/53 SD

[58] Field of Search ..... 93/53 SD, 53 M, 53 R, 93/53 BF, 49 R

[56] References Cited

U.S. PATENT DOCUMENTS

| | | | |
|---|---|---|---|
| 804,716 | 11/1905 | Gay | 93/53 R X |
| 2,699,712 | 1/1955 | Meyer-Jagenberg et al. | 93/53 M |
| 2,984,162 | 5/1961 | Gordon | 93/53 M |

*Primary Examiner*—James F. Coan

*Attorney, Agent, or Firm*—Edwin E. Greigg

[57] ABSTRACT

A method for opening and erecting folded box blanks provides that one side of the blank is grasped and bent outwardly to acquire convex curvature, thereby causing opposite sides of the blank to move away from it, leaving a gap which initiates the opening process. An apparatus for practicing the method provides two suction cups to perform the bending and a stop to apply a force against a bent edge of the blank to cause the erection of the blank to assume its final form.

6 Claims, 4 Drawing Figures

METHOD AND APPARATUS FOR ERECTING FOLDED BLANKS

BACKGROUND OF THE INVENTION

The invention relates to a method and an apparatus for opening and erecting substantially flat-lying, folded blanks, preferably folded box blanks.

Several methods and apparatuses for opening and erecting flat, folded box blanks are known. One of these known devices is that described in the German Offenlegungsschrift No. 22 50 667 according to which the erection of the flat, folded box blank takes place by grasping a long side of the box with a suction device and to move the front edge of the box against a stop. In this known apparatus, the box is carried by the suction device so that gravity acts on the side walls of the box and thereby supports the effort of erecting the box. When the blank is being transported in the upright position, both sides of the box are grasped by pairs of suction devices which force the box to open.

One of the detriments of this known apparatus in which suction devices are used on both sides of the box blank, is that the motion control of the suction devices requires substantial constructional expense and another disadvantage is that this known apparatus does not insure the reliable opening of folded box blanks because the effect of gravity does not provide a forcible opening of the box blank.

Yet another disadvantage of the known apparatus is that folded blanks cannot be opened from any desired position. In particular, the known apparatus is incapable of opening boxes from many common and preferred original positions.

OBJECT AND SUMMARY OF THE INVENTION

It is a principal object of the invention to provide a method and an apparatus capable of opening and erecting tube-like, substantially flat-lying folded box blanks. It is a particular object of the invention to provide a method and an apparatus to open box blanks from positions in which they cannot be opened with known apparatus or only with considerable expenditure of effort and expense.

These and other objects are attained, according to the invention, by providing that the opening is initiated with the deformation of one side of the folded box blank followed by an erection of the box blank. The deformation of one of the sides of the box blank, preferably a long side, takes place by bending the same. During the further opening process, the initiation of the opening performed by bending one of the long sides proceeds by applying a force to the front and/or rear folded edge of the box blank until the box blank is entirely opened and erected.

A method and apparatus for performing this function performs the release, i.e., the distancing of adjacent parts of a folded box blank, by, at first, only a few millimeters, but with complete assurance, because the bending of one of the long sides of the box blank causes the angle formed by the two opposite long sides to be less than 180°. This fact assures a forcible opening and excludes any possibilities for failure, for example due to the failure of gravity to supply a sufficient opening force, etc. The continuing process of erection in which the angle formed by the long sides referred to above is further reduced by forces applied to appropriate edges of the box, generally takes place without further difficulty by a bending of the surfaces of the box about lines defined by scratches or folds.

The apparatus used, according to the invention, for carrying out this method includes members, preferably suction members for deforming one long side of the folded box blank. If two grasping members are used to deform the long side of the box, they may be inclined toward one another. However, it is also possible to provide mutually movable grasping members only one of which is a suction member.

It will be understood that other apparatus embodiments are capable of performing the method according to the invention by bending one side of the box blank and thereby to insure opening and erection. When two mutually movable suction members are used, there is obtained a relatively simple mechanism requiring only a few elements to control their motion. A substantial advantage is to be seen in that such an apparatus insures the secure grasping and bending of one long side of the folded box blank and thereby assures a forcible opening and erection of the box blank. Yet another and substantial advantage of the invention is to be seen in that it makes possible to open and erect a folded box blank independently of its instantaneous position, in particular bowed and deformed folded box blanks.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
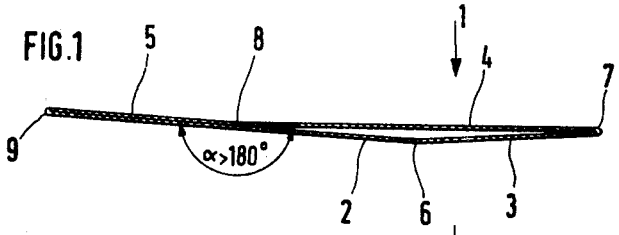
FIGS. 1–4 of the drawing illustrate in sequence the method of opening and erecting a box blank according to the invention and include elements of an apparatus for performing that method.
Figure 2:
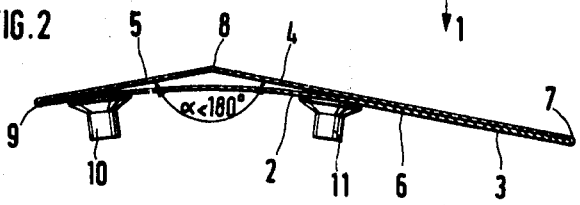
Figure 3:
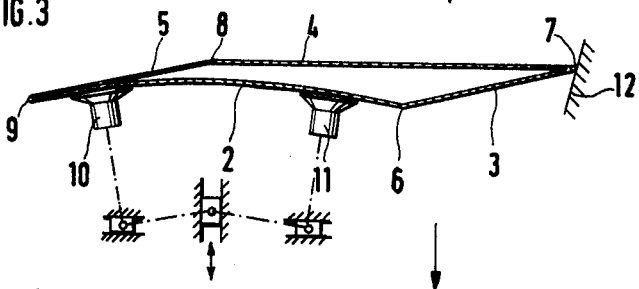
Figure 4:
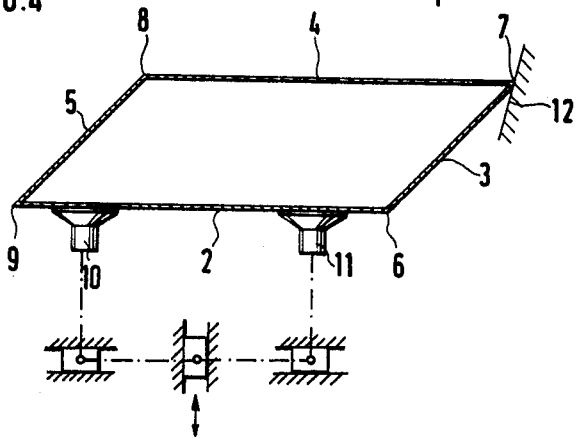

Turning now to FIG. 1, there is illustrated schematically a lateral section of a folded box blank 1 having sides 2, 3, 4 and 5, as well as folded edges 6, 7, 8 and 9. The box is shown in a position from which it would be very difficult or impossible to open and erect the box using known methods and apparatus because, as shown, the sides 4 and 5 form an angle $\alpha$ which is greater than 180°. Thus, when one of the top sides is picked up by a grasping member, for example a suction member, the box does not necessarily open up and can be opened only by applying a deliberate further effort. In particular, the force of gravity may not suffice to cause the lower parts of the box to descend. By contrast, the method according to the invention does provide a forcible opening effort as will be illustrated in further FIGS. 2–4. FIG. 2 illustrates suction members 10 and 11 which are applied to the side 2 of the folded box blank 1. By suitable mutual displacement of the suction members 10 and 11, by known means not further illustrated, the side 2 is curved, thereby making the angle $\alpha$ defined by the opposite two sides 4 and 5 to be less than 180° and causing a forcible slight opening of the folded box blank 1. Subsequent to this initial opening of the box blank 1, which represents the most difficult part of the erection process, the further erection takes place by moving the box so that the folded edge 7, for example, engages a stop 12. The final erection process beginning with the position shown in FIG. 4 until a complete rectangular box is obtained can be performed by suitable construction of the stop 12 or by other suitable means, for example movable means engaging the folded edge 7 which can be of known construction and are not further illustrated, as they represent no particular difficulty.

The function of the suction members 10 and 11 could be performed also by mechanical elements grasping, for example, the side 2 of the folded box blank 1. It might also be suitable in some cases to employ only a single suction member, for example the member 11, and to replace the suction member 10 by suitable mechanical or other grasping elements.

Generally, the method according to the invention may be performed by a variety of apparatus and the previously described apparatus is to be regarded only as a possible exemplary but preferred embodiment.

The primary requirement which must be met by the apparatus used in performing the method of the invention is that is must perform a deformation of one side of the box blank 1 in such a manner as to force the box blank to be opened.

Thus, other embodiments and variants of the invention are possible within the spirit and scope of the invention, the latter being defined by the appended claims.

What is claimed is:

1. A method for opening and erecting a tubular, substantially flat blank, especially a folded box blank having pairs of sides of different length, comprising the steps of:

advancing plural suction elements into a position to engage one long side wall of said flat blank;

applying vacuum to said suction elements;

retracting said plural suction elements together with said side wall of said flat blank to begin erecting said flat blank;

moving said flat blank into engagement with a stop means; and continuing to pull said flat blank into a fully opened erect state.

2. A method as defined by claim 1, wherein erecting of said folded box blank is achieved by deforming said one long side of said blank by said suction elements grasping it on a side opposite to a folding edge of said blank, and said step of erection is performed by applying a force to one of the folded edges of said blank until the blank has attained its intended finished form.

3. An apparatus for opening and erecting tubular, substantially flat blanks, especially folded box blanks, of rectangular configuration comprising:

at least two suction devices for grasping different portions of one long side of said blank; said grasping operation being arranged to produce in said one long side a curvature due to bending which causes the opposite sides of the blank to move away from said one long side, thereby initiating the opening of said blank.

4. An apparatus as defined by claim 3, wherein said suction devices are capable of relative motion.

5. An apparatus as defined by claim 3 in which said grasping operation initially causes a convex curvature in the said one long side of said folded box blank.

6. An apparatus as defined by claim 5, wherein the planes of action of said suction devices are mutually inclined.

* * * * *